US005791105A

United States Patent [19]

Gangi

[11] Patent Number: 5,791,105

[45] Date of Patent: Aug. 11, 1998

[54] MODULE FOR THE PRODUCTION OF AN ALL-GLASS FACADE

[75] Inventor: Aurelio Gangi, Soumagne, Belgium

[73] Assignee: L'Atelier Du Verre S.A., Alleur, Belgium

[21] Appl. No.: 393,013

[22] PCT Filed: Aug. 30, 1993

[86] PCT No.: PCT/BE93/00054

§ 371 Date: Apr. 13, 1995

§ 102(e) Date: Apr. 13, 1995

[87] PCT Pub. No.: WO94/05888

PCT Pub. Date: Mar. 17, 1994

[30] Foreign Application Priority Data

Aug. 31, 1992 [BE] Belgium ..... 09200770

[51] Int. Cl.[6] ..... E04B 2/96

[52] U.S. Cl. ..... 52/235; 52/204.1; 52/272; 52/489.1; 52/769; 52/745.15; 52/747.1

[58] Field of Search ..... 52/235, 127.3, 52/208, 204.599, 786.1, 786.11, 582.2, 483.1, 489.1, 489.2, 127.1, 272, 204.1, 475.1, 476, 769, 772, 773, 774, 781

[56] References Cited

U.S. PATENT DOCUMENTS

| | | | |
|---|---|---|---|
| 2,577,342 | 12/1951 | Mancini | 52/476 |
| 3,336,707 | 8/1967 | Horgan, Jr. | 52/235 |
| 3,925,952 | 12/1975 | Hagel et al. | 52/235 |
| 3,974,608 | 8/1976 | Grearson | 52/235 |
| 4,545,161 | 10/1985 | Baumann | 52/235 |
| 4,843,773 | 7/1989 | Richyer | 52/774 |
| 5,184,440 | 2/1993 | Felix et al. | 52/235 |

FOREIGN PATENT DOCUMENTS

| | | |
|---|---|---|
| 2650609 | 2/1991 | France . |
| 3816619 | 11/1989 | Germany . |
| 8500516 | 9/1986 | Netherlands . |
| 8702813 | 6/1989 | Netherlands . |
| 8801294 | 12/1989 | Netherlands . |
| 945634 | 1/1964 | United Kingdom . |

*Primary Examiner*—Michael Safavi
*Attorney, Agent, or Firm*—Sidley & Austin

[57] ABSTRACT

The module comprises a stainless sheet steel framework 40 shaped to provide a rabbet 38 for receiving a double glazing and a stiffening element 3 for the fixation of the module or assembly 41, i.e., the framework 40 and the glazing assembly to the supporting structure of the building facade. To enable direct fixing into the supporting structure, the stiffening element 3 is associated with a stainless steel spring tab 4 located on the supporting structure which allows clipping of the assembly 41 to the supporting structure 5. The space between the rabbets of two adjacent modules is reduced to that required for housing a calibrated, preformed EPDM seal.

31 Claims, 8 Drawing Sheets

FIG. 8
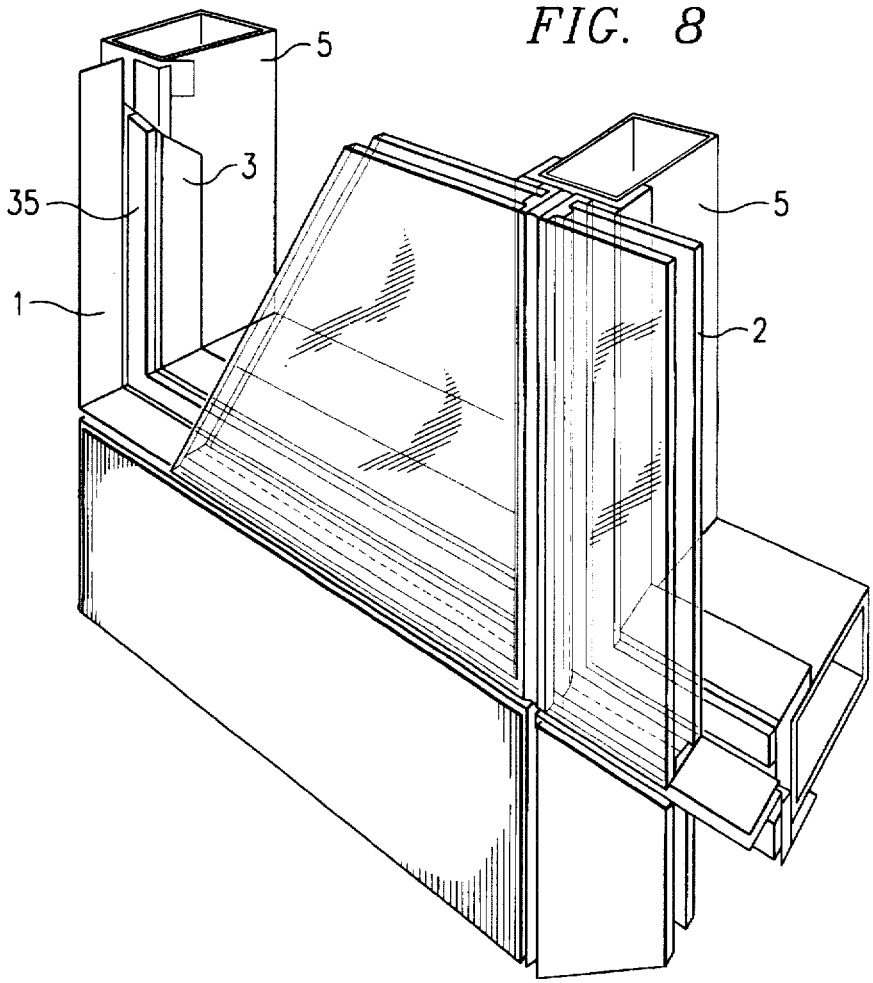
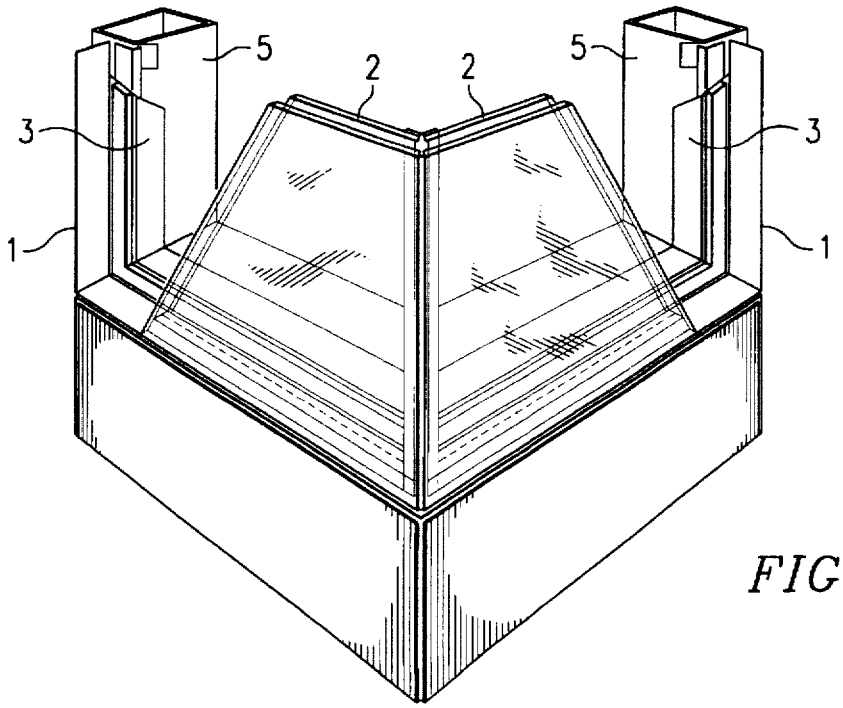
FIG. 9

MODULE FOR THE PRODUCTION OF AN ALL-GLASS FACADE

TECHNICAL FIELD

The present invention relates to a module for the production of an all-glass facade in the construction of a building and is connected with the technique called structural glazing, in which a glazing covers a frame.

BACKGROUND OF THE INVENTION

Since the production of a first all-glass facade, the technique of installing glazing has developed little. Although, at the outset, the retention of very small glasses was carried out by metal profiles, very quickly the glazing was placed in rabbets. An added peripheral element prevented the glass from coming out of the rabbet while at the same time ensuring impermeability with the aid of a filling putty, various cover strips or rubber seals.

In recent years, all-glass facade research has led contractors to reduce the section of the frames made of steel or aluminum.

The general use of aluminum, which has a high coefficient of expansion, has compelled contractors to look for a solution to the problems of expansion between the structure, the frames and the glazing. The result is a joint gap of more or less 20 mm between the various modules. On the other hand, the projecting or re-entrant angles necessitate one or two angle profiles. Although these frames are intended for assemblies which are in principle fixed, taking air-conditioning installations into account, the production of an opening part is possible if insertion into the all-glass facade of a frame which has an opening panel and a case is accepted. This frame with an opening panel and a case is generally wider than the other frames and for this reason is too noticeable in an all-glass facade.

U.S. Pat. No. NL 8500516 issued Sep. 16, 1986 to Compri-Aluminum BV discloses a module and a method making it possible to renovate the glazing of an existing building provided with frames made of wood. The module is capable of supporting a double glazing and comprises, on each side, a gripping tab, one of which is capable of being held in place by a boss fixed against a first frame case while the other is capable of snapping in behind a spring lamella fixed against a second case.

The spring lamella serves only to indicate if the putting in place of the module is correct. Definitive putting in place is carried out with the aid of a stud fixed in the masonry.

U.S. Pat. No. DE 3816619 issued Nov. 30, 1989 to P. Jordan. Discloses a glazing known which is intended for covering a building facade of the structural glazing type. The glazing is supported by a module formed by an angle made of profiled stainless steel sheet. The angle is a simple corner piece stuck to a pane fixed by eye bolts. The fixing of the modules to one another is an extremely delicate operation which necessitates a perfect alignment of the modules which are not necessarily supported on a supporting structure of the facade.

SUMMARY OF THE INVENTION

The aim of the invention is to produce, following the technique called structural glazing, an all-glass facade, in which the space between two juxtaposed modules is greatly reduced and in which no angle profile is necessary.

The module according to the invention is characterized in that it comprises a framework made of stainless steel sheet which is profiled so as to produce, on the one hand, a rabbet intended to receive a double glazing and, on the other hand, a stiffening element which makes it possible to fix the assembly—surround and glazing—in the supporting structure of the facade.

The stiffening element has, in order to allow direct fixing in the supporting structure of the facade, an end which is bent towards the inside of the module. This bent end is associated with a stainless steel spring sheet borne by the structure.

According to one embodiment of the invention, an elastically deformable element, to allow the clipping of the module on the structure, equipped with the first, is constituted by the ends of a flat spring made of stainless steel sheet in the shape of a chair and riveted at its center to the structure, the first end of the spring serving for attaching the module and the second end ensuring the elastic thrust.

The invention also relates to an all-glass facade constituted by said modules. In this facade, the space comprised between the rabbets of two juxtaposed surrounds is reduced to the simple housing of a silicone seal.

BRIEF DESCRIPTION OF THE DRAWINGS

To make the invention easier to understand, it is described in greater detail on the basis of the attached drawings, by way of example only, in which:

FIG. 8 is a partial view in perspective of a portion of facade according to the invention;

FIG. 9 is a partial view in perspective of an angled portion of facade according to the invention;

DETAILED DESCRIPTION

A module for producing an all-glass facade, according to the invention, is constituted by a framework made of stainless steel sheet. Stainless steel is used because it has a very low coefficient of expansion of a value close to that of glass. On the other hand, like glass, it is stable and does not deteriorate. It needs no maintenance.

Figure 1A:
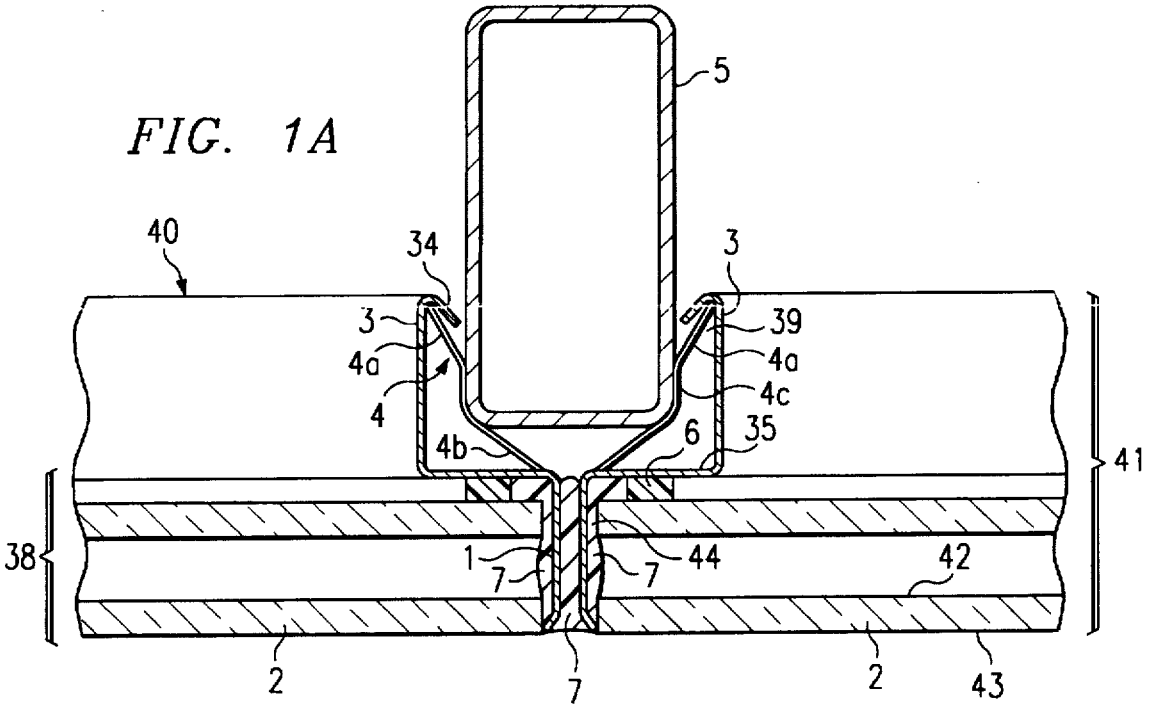
FIG. 1 is a view in cross-section of the assembly of two fixed, juxtaposed modules according to the invention.
Figure 1B:
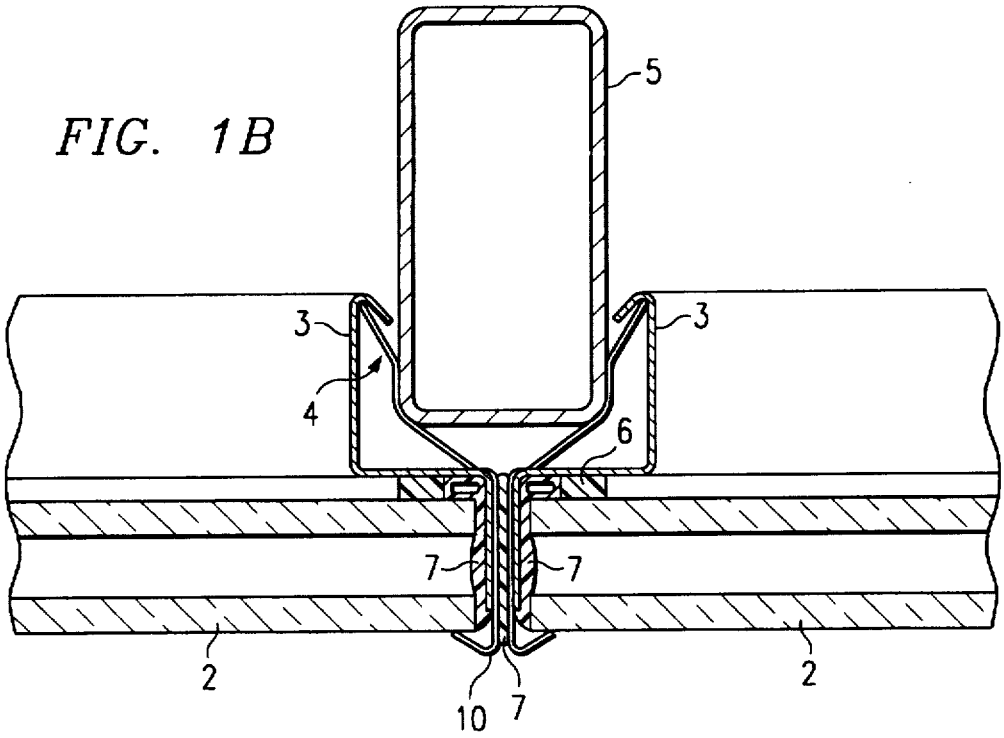

As illustrated in FIG. 1, the framework, made of polished stainless steel sheet, is profiled so as to produce, on the one hand, a rabbet 1 intended to receive a double glazing 2, and, on the other hand, a stiffening element 3 which, associated with a stainless steel spring tab 4 borne by the structure 5 brings about the fixing by clipping to said supporting structure.

The stiffening element 3 is an angle made of stainless steel, one wing of which has, at one end, an edge which is bent towards the inside of the module. This makes it possible to fix an assembly 1–3 constituted by a surround 1,3 and a glazing into the supporting structure of the all-glass facade.

The framework is in fact constituted by two plane surfaces 1, 3 which are offset in relation to one another by a distance equal to the height of the stiffening element 3.

The double glazing 2 is arranged in the rabbet on a calibrated seal 6 which makes it possible to produce the section necessary for the special structural glazing silicone 7.

The latter is drawn around the entire external and internal periphery of the rabbet.

The stiffening element 3 is associated with a first stainless steel tab 4 which forms a spring nose. This tab 4 is elastic and riveted to the structure a few millimeters from one of its ends. It carries out the clipping of the fixed surround 1,3 of the module.

An elastic deformable element, mounted against a web of the stiffening element 3, makes possible clipping of the module on the supporting structure 5 of the all-glass facade.

Figure 2:
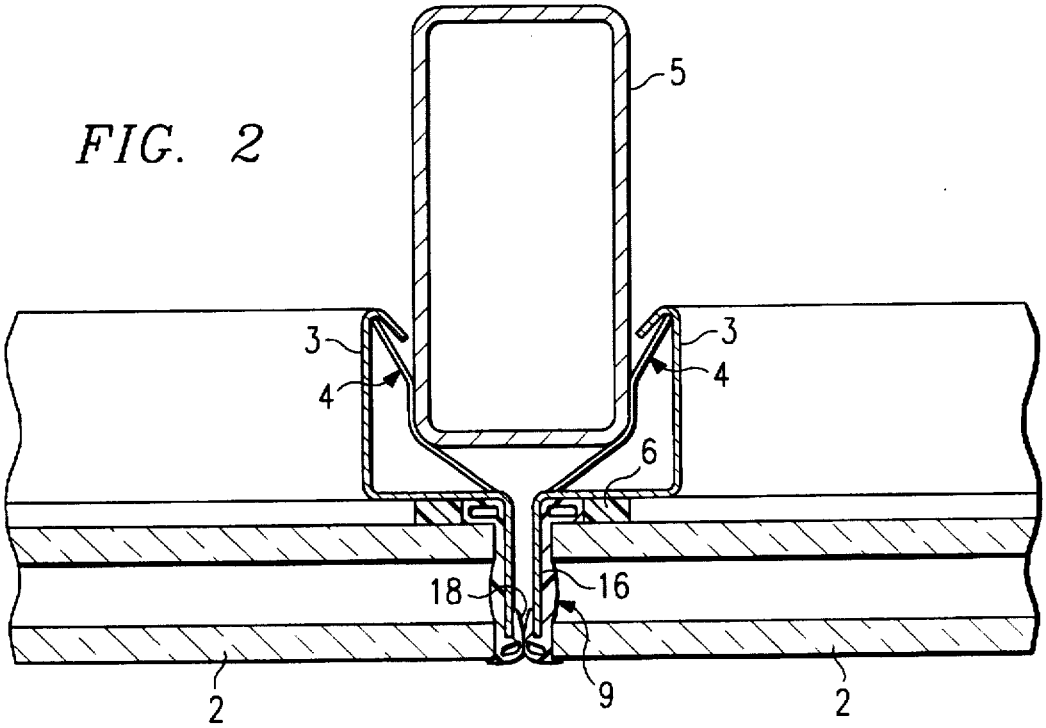
FIG. 2 is a variant of FIG. 1.

In a first embodiment illustrated in FIG. 2, the elastically deformable element is a compressible peripheral seal 8 which makes possible clipping of the modules on the structure 5 equipped with stainless steel spring clips 4.

In a second embodiment illustrated in FIG. 1, the elastically deformable element, to make possible clipping of the module on the structure 5, is constituted by a second end of a flat spring made of stainless steel sheet in the shape of a chair and riveted at its center to the structure, the first end 4 of the spring serving for attaching the module and the second end 11 ensuring the elastic thrust.

To make possible clipping of the module on the structure 5 equipped with the first tab 4 made of stainless steel, the elastically deformable element second tab 11 is made of stainless steel arranged in continuation of the first tab 4 so as to form the noses of an elastically deformable anchor, the first nose of which carries out the clipping and the second of which facilitates mounting of the assembly 1-3—surround 1,3 and glazing 2.

The space between two juxtaposed modules or surrounds is reduced to a minimum. This space, not exceeding 10 mm, is filled with a conventional silicone of good quality which brings about the impermeability.

Figure 10:
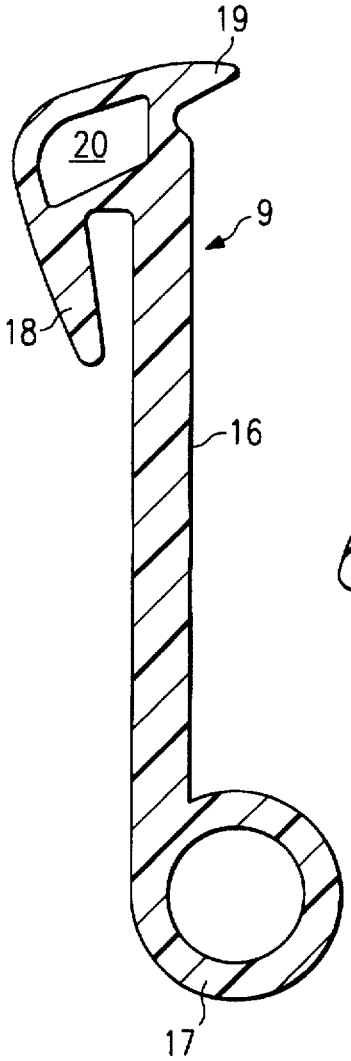
FIG. 10 is a view in cross-section of a particular embodiment of a preformed calibrated seal.

Preferable to the silicone seal is a preformed calibrated seal 9 made of elastic material, preferably of EPDM (rubber based on ethylenepropylene-diene, containing 70% ethylene when the third component is dicyclopentadiene). As illustrated in FIG. 10, this seal comprises a web 16 of constant rectangular section, a first end of which bears laterally, on a first side of the web, a hollow cylindrical bead 17 and a second end of which has a part bent into a point 18 turned towards the other side of the web, as well as a toe 19 protruding from the first side of the web, the base of the toe and of the bent part having a hollow bulge 20 so as to ensure adequate elasticity of the seal.

The glass products making up the double glazing are left to the judgment of the originator of the construction plan but, in general, the assembly will be of the reflective type to provide not only the desired coloration but also the indispensable solar control.

In the rabbet, of course, it is possible to arrange materials other than glass, for example, marble, stainless steel sheet, PVC etc.

In FIG. 2, the same assembly of modules as in FIG. 1 has been represented but with an added surround 10, which makes it possible to secure mechanically the surround/double glazing assembly.

In an opening module (FIG. 3), the stiffening element 3 of the framework is moved apart greatly from the structure 5 to be associated with a receiving profile made of stainless steel borne by said structure.

Figure 3:
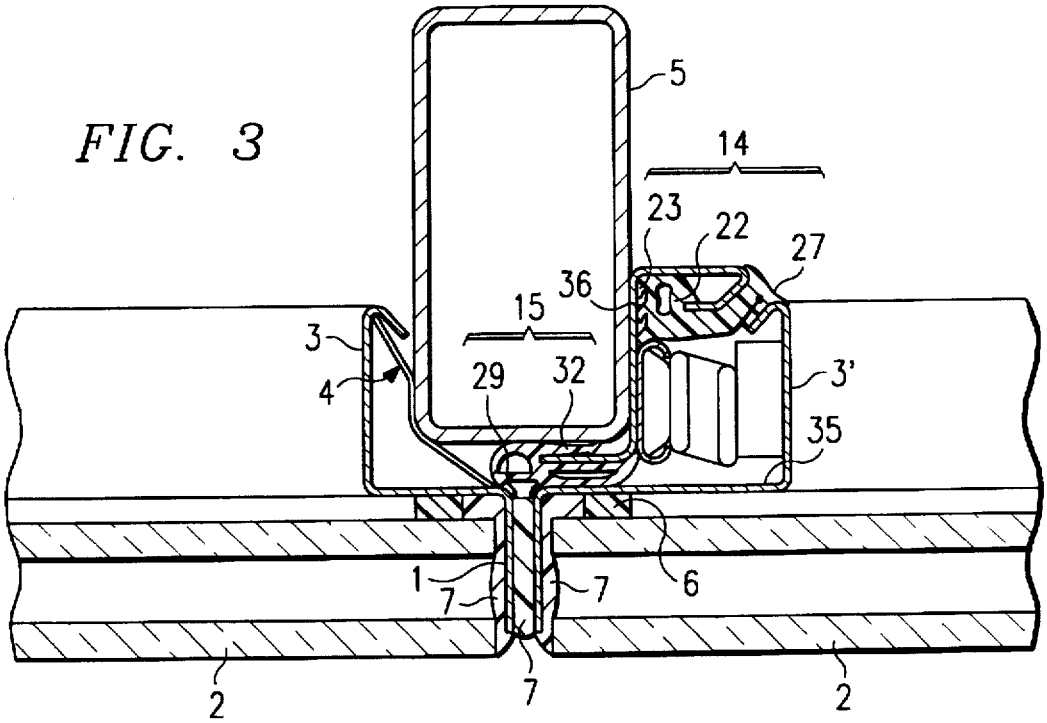
FIG. 3 is a view in cross-section of the assembly of two juxtaposed modules according to the invention, one fixed and the other opening.
Figure 7:
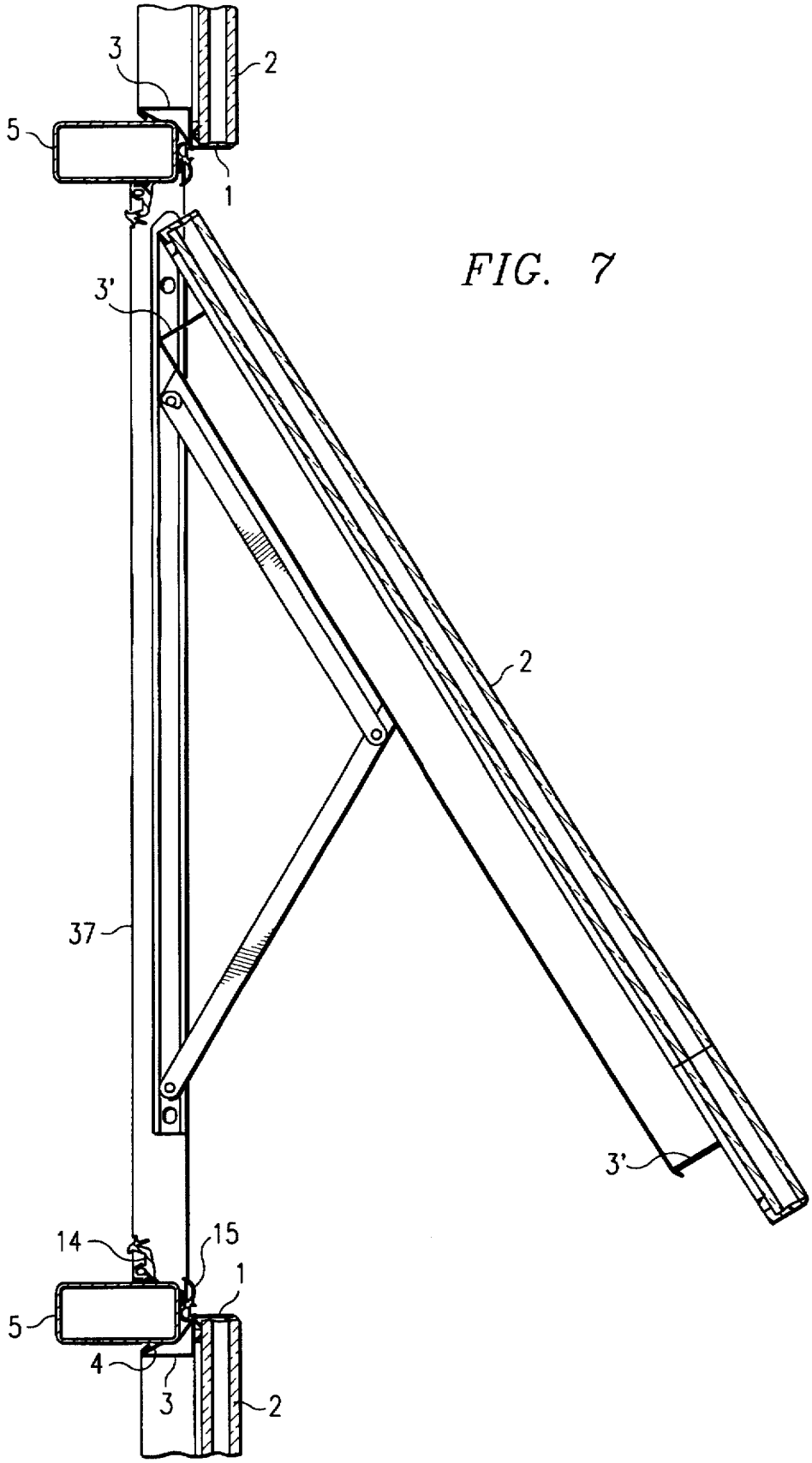
FIG. 7 is a view in cross-section of an opening surround, according to the invention, in the open position.

As illustrated in FIGS. 3 and 7, a clipped seal 14 and an impermeability seal 15, both mounted on the added surround 10' of the opening module, ensure impermeable closing between the supporting structure and the case constituted by the added surround 10' and the opening module.

Figure 4:
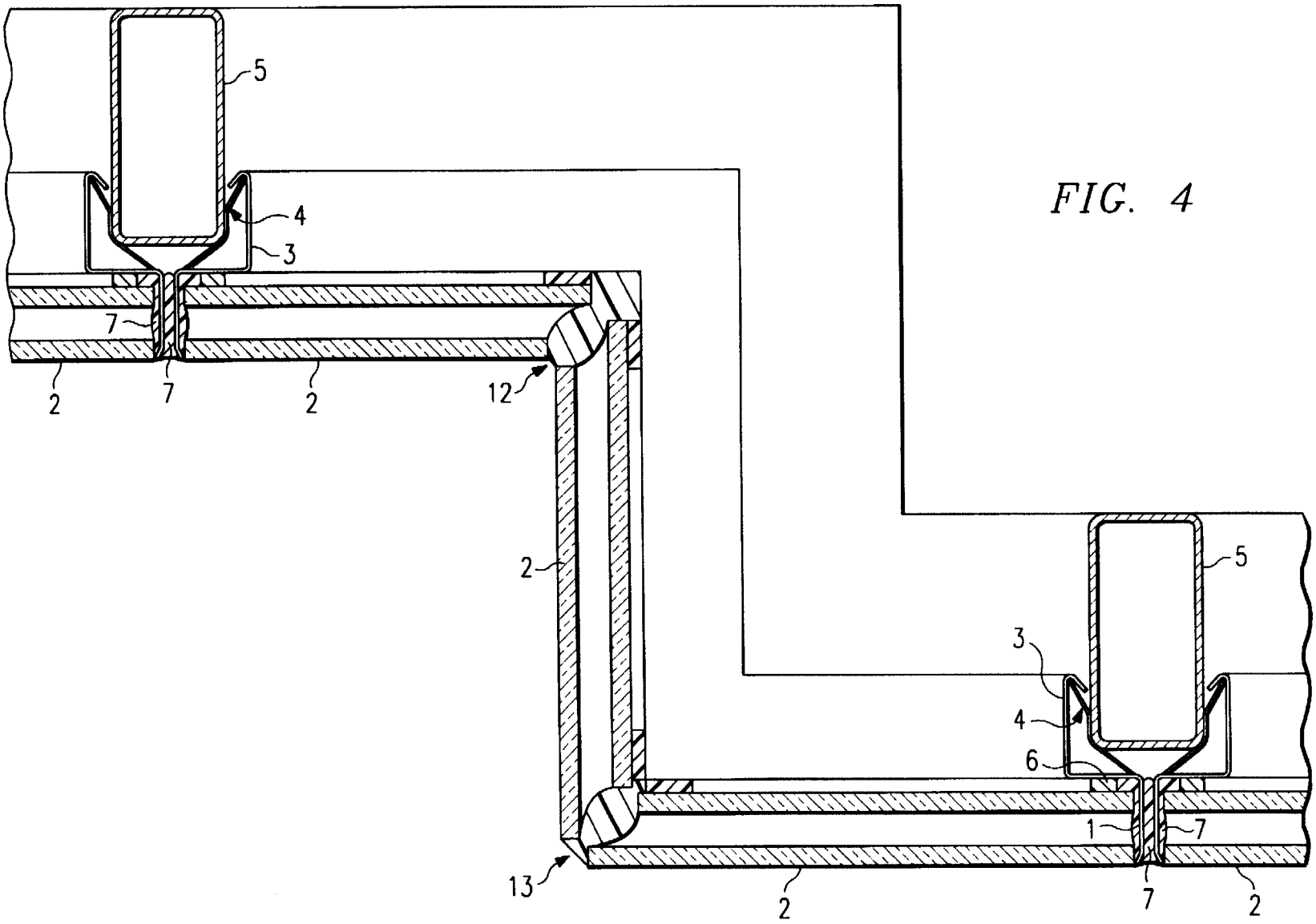
FIG. 4 is a view in cross-section of the assembly of fixed, juxtaposed modules, according to the invention, one of which comprises a re-entrant corner and a projecting corner.

The production of re-entrant and/or projecting angles is carried out with the same joint gap of the order of 10 mm between two neighboring modules, only the dimension and the shape of the surrounds are different. In FIG. 4, a module can be seen-with a re-entrant corner 12 and a projecting corner 13. The corresponding framework is produced with an angle in the factory by assembly of three surrounds welded at 45°. Such an angled framework is fitted into the skeleton in the same manner as a plane framework.

Figure 11:
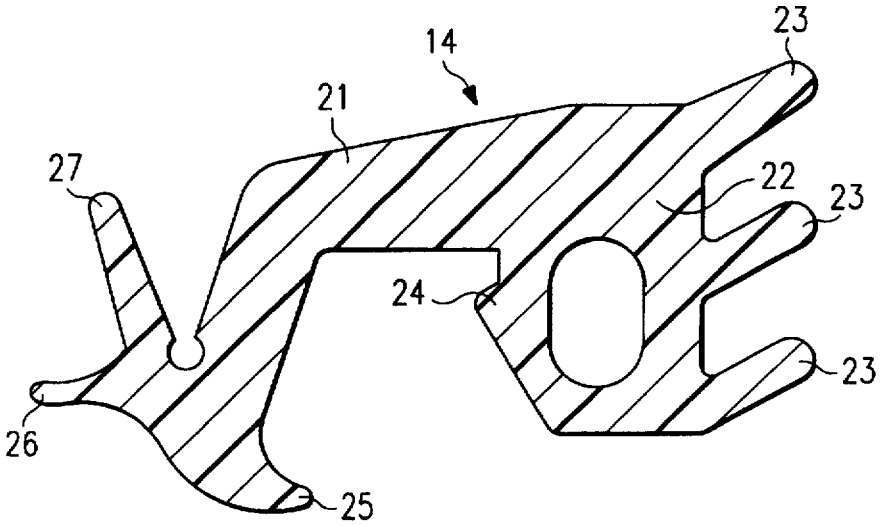
FIG. 11 is a view in cross-section of a first clipped seal for an added surround of the case of a movable frame.

The clipped seal 14 is made of elastic material, preferably of EPDM. It comprises, as illustrated in FIG. 11, an extruded web of broken section 21 bearing at a first end a hollow bulging heel 22 provided with three parallel sealing lips 23 directed towards the outside and a toe 24 arranged on an internal tab of the heel. At the other end, three snapping-in branches 25, 26, 27 are arranged in a star shape around a second end of the web.

Figure 12:
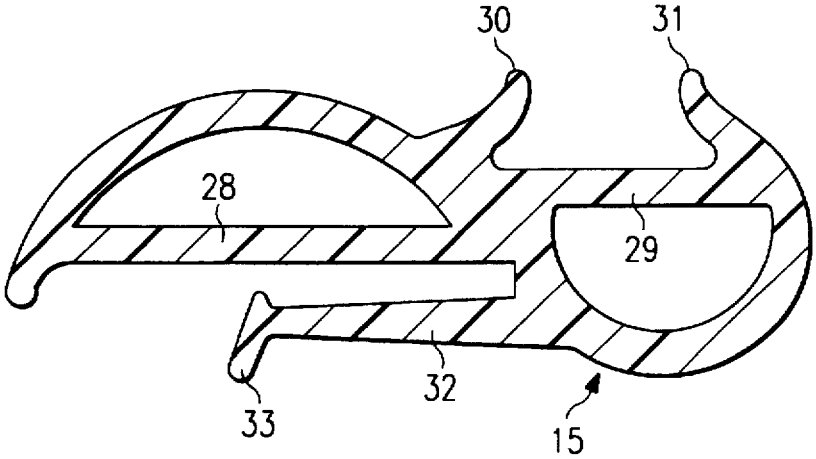
FIG. 12 is a view in cross-section of a second seal an added surround of the case of a movable frame wherein like number refer to like parts.

The impermeability seal shown in FIG. 12 is likewise made of elastic material, preferably of EPDM. It comprises a hollow web 28 of semi-circular section folded on itself at 180°, in line with a hollow thickening core 29 provided on a first side of the web with two sealing lips 30, 31 to form a leg 32 and a heel 33 arranged along the second side of the web.

Figure 5:
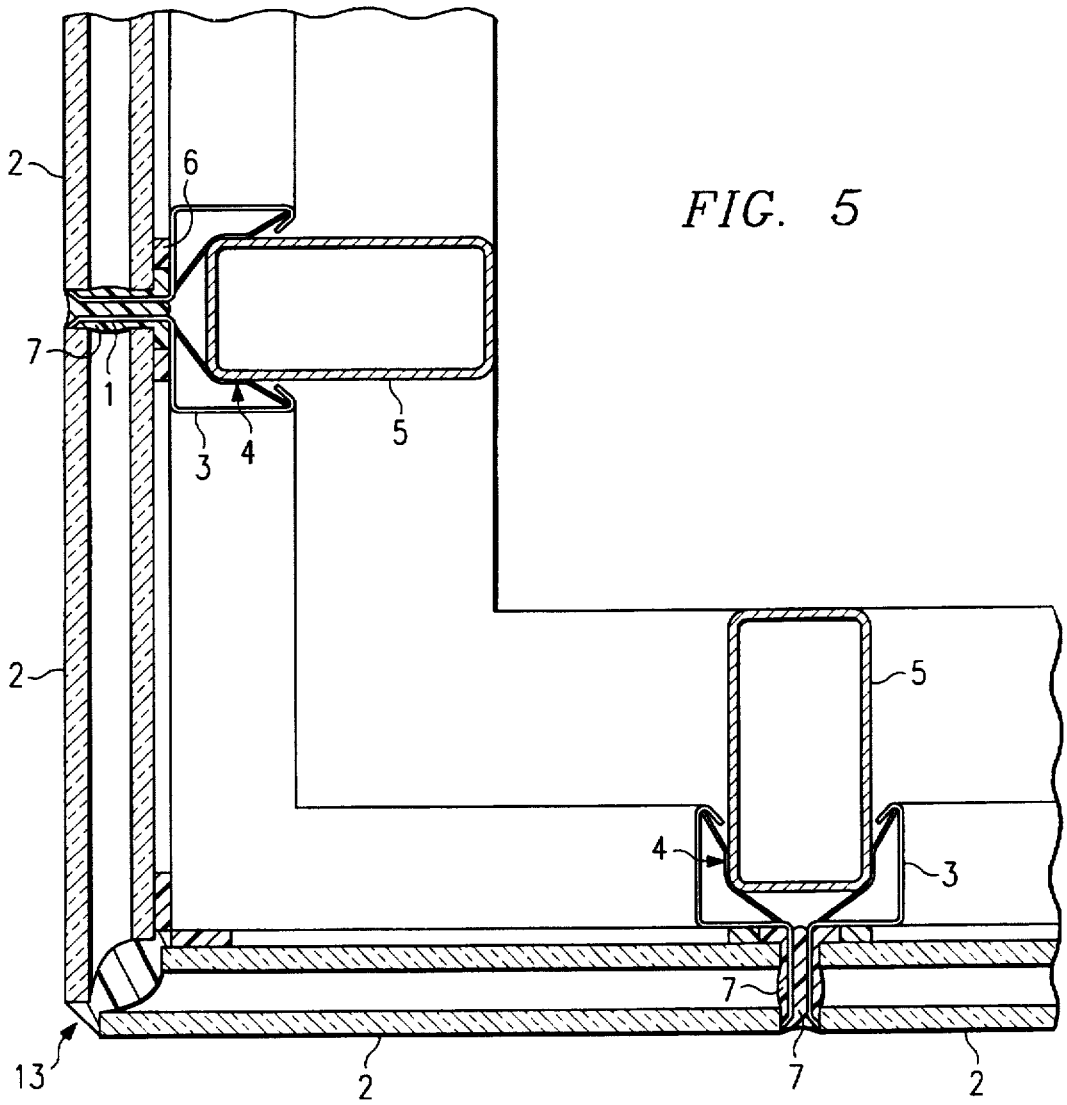
FIG. 5 is a view in cross-section similar to that in FIG. 4 with a projecting corner.
Figure 6:
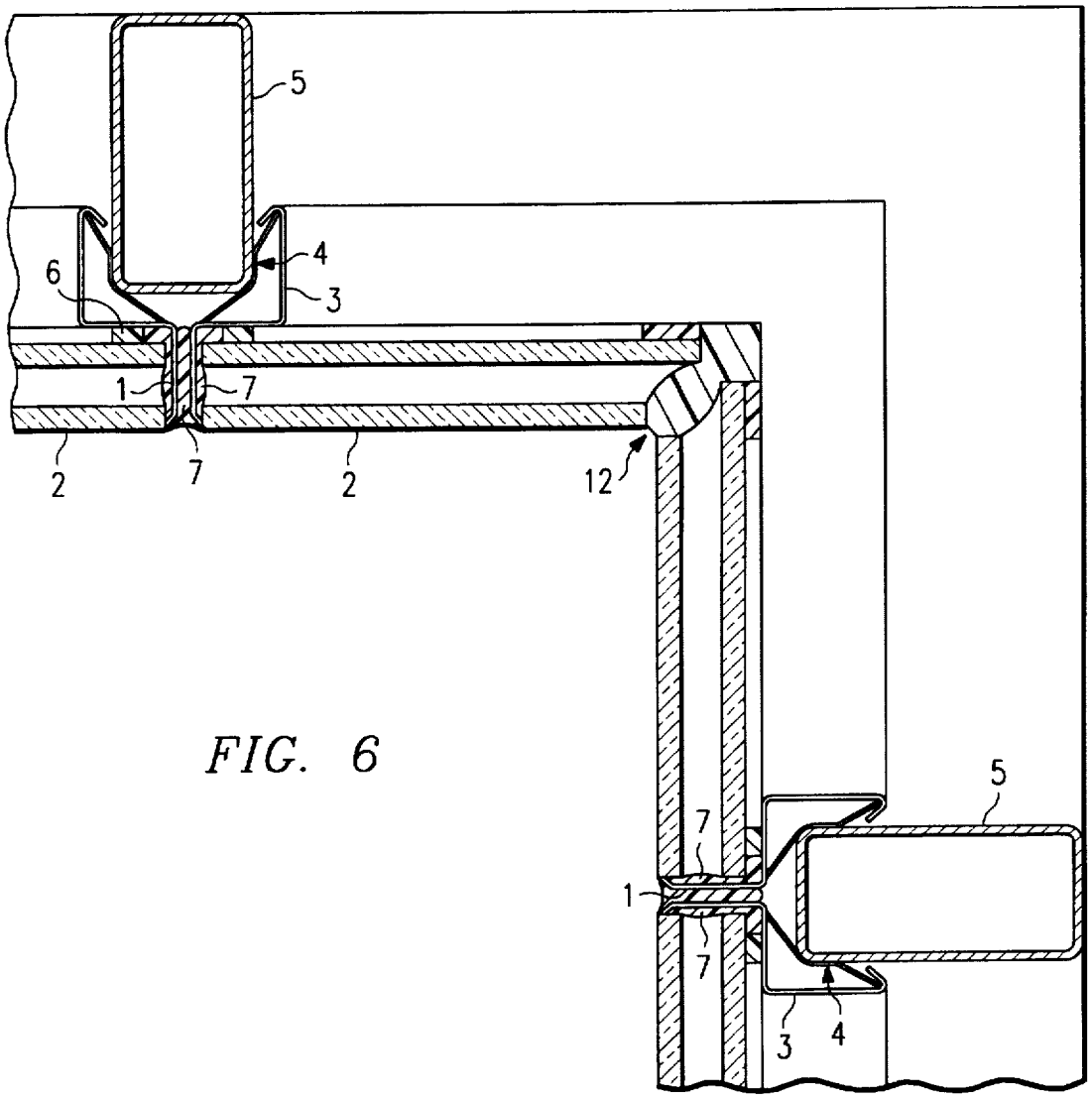
FIG. 6 is a view in cross-section similar to that in FIG. 4 with a re-entrant corner.

For a projecting angle 13 (FIG. 5) or a re-entrant angle 12 (FIG. 4), the corresponding framework is made with an angle in the factory by assembly of two surrounds welded at 45°. This angled framework is fitted into the skeleton in the same manner as a plane framework but one of the sides of the supporting structure must be demountable.

I claim:

1. A module for construction of a building facade having building face supports, comprising:

a framework adapted to attach to said building facade supports; and one or more material panels secured in said framework;

said framework comprising linear members interconnected to form a substantially rectangular shape, each of said linear members having a first planar member and a second planar member wherein said first and second planar members are substantially parallel and offset in relation to one another by a spacing element, wherein a portion of said second planar member is bent toward said spacing element to form a receiving groove adapted to receive a portion of a spring tab located on said building facade supports, said spacing element and said first planar member together forming a rabbet adapted to receive said one or more material panels, the rabbets of each of the linear members oriented to form a continuous rabbet in said framework when said linear members are interconnected to form said framework, said material panels having a first face, a second face and four end surfaces, said end surfaces located adjacent said continuous rabbet.

2. The module of claim 1, wherein said framework is made of stainless steel.

3. The module of claim 1 further comprising silicone interspersed between said rabbet and said material panels.

4. The module of claim 1 further comprising a preformed calibrated seal between said rabbet and said material panels.

5. The module of claim 4 wherein said preformed calibrated seal comprises a web of constant rectangular shape with a first and a second end, wherein said first end extends laterally, from a first side of said web of constant rectangular shape to form a hollow, elastically deformable cylindrical bead and said second end has a part bent into a point, the part bent toward the other side of the web of constant rectangular shape forming a grove for attachment to said framework, and a toe protruding from said first side of said web of constant rectangular shape, a base of the toe and of the bent part having a hollow bulge to ensure elasticity of said seal.

6. The module of claim 1 comprising two or more material panels, each of said panels having a first face, a second face and four end surfaces, each of said end surfaces located adjacent said continuous rabbet, (each of said material panels in a parallel alignment with respect to another of said other panels).

7. The module of claim 6 wherein said material panels are glazings.

8. The module of claim 1, wherein said module further comprises a calibrated seal adjacent to said spacing element and said first face of said material panel.

9. The module of claim 8 comprising a first material panel and a second material panel, wherein said first face of said first material panel is adjacent to said calibrated seal, said first face of said second material panel is adjacent to said second face of said first material panel, and said end surfaces of said first and second material panels are adjacent to said continuous rabbet.

10. The module of claim 9 wherein said material panels are glazings.

11. An opening module for construction of a building facade having building facade supports comprising:

a surround adapted to attach to said building facade supports;

a receiving profile operatively associated with said surround;

a framework hingedly attached to said surround; and one or more material panels secured in said framework;

said framework comprising interconnected linear members, each of said linear members having a first planar member and a second planar member wherein said first and second planar members are substantially parallel and offset in relation to one another by a spacing element, wherein a portion of said second planar member is bent toward said spacing element to form a sealing edge, said spacing element and said first planar member together forming a rabbet adapted to receive said one or more material panels, the rabbets of each of the linear members oriented to form a continuous rabbet in said framework when said linear members are interconnected to form said framework;

said material panels having a first face, a second face and four end surfaces, each of said end surfaces located adjacent said continuous rabbet.

12. The opening module of claim 11 wherein said receiving profile comprises a flat central portion attachable to said building facade supports, a first arm extending substantially perpendicular to said central portion from a first end of said central portion, and a second arm extending substantially perpendicular to said central portion in the opposite direction of said first arm from a second end of said central portion, wherein the tip of said first arm is bent at a first angle and then at a second angle such that said first arm has two spaced, substantially parallel portions.

13. The opening module of claim 12 further comprising elastically deformable seals wherein said receiving profile is operatively associated with said elastically deformable seals to ensure impermeable closing.

14. The opening module of claim 13 wherein said elastically deformable seals comprise a clipped seal operatively associated with said first arm of said supporting element and an impermeability seal operatively associated with said second arm of said supporting element.

15. The opening module of claim 14 wherein said clipped seal comprises a central broken web bearing at a first end a hollow bulging heel provided with three parallel sealing lips directed toward the outside and a toe arranged on an internal tab of said heel, and around a second end of the web three branches arranged in a star shape.

16. The opening module of claim 14 wherein said impermeability seal comprises a hollow web of semi-circular section folded on itself at 180° in line with a hollow thickening core provided on a first side of the web with two sealing lips to form a leg and a heel arranged along the second side of the web.

17. The opening module of claim 14 further comprising a means for securing the module in a closed position attached to said central portion of the supporting element.

18. The opening module of claim 17 wherein said means for securing the module in a closed position comprises a C-shaped clamp, said clamp having an upper curved portion adjacent to said clipped seal, and a bottom curved portion adjacent to said impermeability seal.

19. The opening module of claim 17 wherein the framework further comprises a means for securing the module in a closed position attached to said second planar member.

20. The opening module of claim 19 wherein said means for securing the module in a closed position comprise a plurality of flexible elements, one of which is geometrically conformable to the means for securing the module in a closed position attached to the central portion of a supporting element.

21. A module for construction of a building facade having building facade supports, comprising:

a non-planar framework adapted to attach to building facade supports; and at least two non-parallel material panels secured in said framework;

said framework comprising interconnected linear members, each of said linear members having a first planar member and a second planar member wherein the first and second planar members are substantially parallel and offset in relation to one another by a spacing element wherein a portion of said second planar member is bent toward said spacing element to form a receiving groove adapted to receive a portion of a spring tab located on said building facade supports, said spacing elements and said first planar member together forming a non-linear rabbet adapted to receive said two or more non-parallel panels, the rabbets of each of the linear members oriented to form a continuous non-linear rabbet in said framework when said rabbets of said members are connected to form said framework, said material panels having a first face, a second face and four end surfaces wherein at least two of said end surfaces of each of said material panels are located adjacent said continuous rabbet.

22. A building facade having building facade supports comprising:

a plurality of spring tabs attached to said building face supports; and a plurality of modules connected to said spring tabs;

each of said modules comprising a framework, said framework comprising linear members interconnected to form a substantially rectangular shape, each of said linear members having a first planar member and a second planar member wherein said first and second planar members are substantially parallel and offset in relation to one another by a spacing element wherein a portion of said second planar member is bent toward said spacing element to form a receiving groove receiving a portion of said spring tabs located on said building facade supports, said spacing element and said first planar member together forming a rabbet adapted to receive said material panels, the rabbets of each of the linear members oriented to form a continuous rabbet in said framework when said rabbets of said linear members are interconnected to form said framework, said material panels having a first face, a second face and four end surfaces, said end surfaces located adjacent and continuous rabbet.

23. The building facade of claim 22 further comprising one or more modules wherein the space between two juxtaposed modules is filled with silicone.

24. The building facade of claim 22 further comprising one or more modules wherein the space between two juxtaposed modules is sealed by a preformed calibrated seal.

25. The building facade of claim 24 wherein the preformed calibrated seal comprises a web of constant rectangular shape with a first and a second end, wherein said first end extends laterally from a first side of said web of constant rectangular shape to form a hollow elastically deformable cylindrical bead and said second end has a part bent into a point, the part bent toward the other side of said web of constant rectangular shape, forming a groove for attachment to said framework, and a toe protruding from the first side of said web of constant rectangular shape, a base of the toe and of the bent part having a hollow bulge to ensure elasticity of the seal.

26. The building facade of claim 22 further comprising one or more opening modules said opening modules comprising:

a surround adapted to attach to said building facade supports;

a receiving profile operatively associated with said surround;

a framework hingedly attached to said surround; and one or more material panels secured in said framework;

said framework comprising interconnected linear members, each of said linear members having a first planar member and a second planar member wherein said first and second planar members are substantially parallel and offset in relation to one another by a spacing element, wherein a portion of said second planar member is bent toward said spacing element to form a sealing edge, said spacing element and said first planar member together forming a rabbet adapted to receive said one or more material panels, the rabbets of each of the linear members oriented to form a continuous rabbet in said framework when said linear members are interconnected to form said framework;

said material panels having an a first face, a second face and four end surfaces, each of said end surfaces located adjacent said continuous rabbet.

27. The building facade of claims 22, wherein said material panels are glazings.

28. The building facade of claim 26, wherein said material panels are glazings.

29. A framework comprising linear members interconnected to form a substantially rectangular shape each of said linear members having a first planar member and a second planar member wherein said first and second planar members are substantially parallel and offset in relation to one another by a spacing element wherein a portion of said second planar member is bent toward said spacing element to form a receiving groove adapted to receive a spring tab located on building facade supports, said spacing element and said first planar member together forming a continuous rabbet.

30. A method for constructing a building facade having building facade supports comprising:

attaching to said building facade supports spring tabs;

providing a plurality of modules having one or more material panels secured therein, each module comprising a framework, said framework comprising interconnected linear members, each of said linear members having a first planar member and a second planar member wherein first and second planar members are substantially parallel and offset in relation to one another by a spacing element wherein a portion of said second planar member is bent toward said spacing element to form a receiving groove adapted to receive a portion of said spring tabs located on said building facade supports, said spacing element and said first planar member together forming a rabbet adapted to receive said one or more material panels the rabbets of each of the linear members oriented to form a continuous rabbet in said framework when said rabbets of said linear members are interconnected to form said framework, said material panel having a first face, a second face and four end surfaces, said end surfaces adjacent said continuous rabbet; and attaching said modules to said spring tabs on said building facade supports by means of the receiving grooves.

31. The method of claim 30 further comprising providing a plurality of opening modules, said opening modules comprising:

a surround adapted to attach to said building facade supports;

a receiving profile operatively associated with said surround;

a framework hingedly attached to said surround; and one or more material panels secured on said framework;

said framework comprising interconnected linear members, each of said linear members having a first planar member and a second planaer member wherein said first and second planar members are substantially parallel and offset in relation to one another by a spacing element wherein a portion of said second planar member is bent toward said spacing element to form a sealing edge, said spacing element and said first planar member together forming a rabbet adapted to receive said one or more material panels, the rabbets of each of the linear members oriented to form a continuous rabbet in said framework when said linear members are interconnected to form said framework;

said material panels, having an a first face, a second face and four end surfaces, said end surfaces located adjacent said continuous rabbet.

* * * * *